US012157030B1

(12) United States Patent
Harden

(10) Patent No.: US 12,157,030 B1
(45) Date of Patent: Dec. 3, 2024

(54) PIVOTING DUMBBELL

(71) Applicant: Maurice Harden, Riverview, FL (US)

(72) Inventor: Maurice Harden, Riverview, FL (US)

( * ) Notice: Subject to any disclaimer, the term of this patent is extended or adjusted under 35 U.S.C. 154(b) by 152 days.

(21) Appl. No.: 17/969,849

(22) Filed: Oct. 20, 2022

(51) Int. Cl.
*A63B 21/072* (2006.01)
*A63B 21/00* (2006.01)
*A63B 21/04* (2006.01)
*A63B 21/055* (2006.01)

(52) U.S. Cl.
CPC ..... *A63B 21/0726* (2013.01); *A63B 21/0414* (2013.01); *A63B 21/0557* (2013.01); *A63B 21/4047* (2015.10)

(58) Field of Classification Search
CPC ..... A63B 21/0726; A63B 21/0414; A63B 21/0557; A63B 21/4047
See application file for complete search history.

(56) References Cited

U.S. PATENT DOCUMENTS 4,690,399 A 9/1987 Hayashi
6,203,476 B1 * 3/2001 Wang ..... A63B 21/0618 482/121
7,628,735 B1 12/2009 Hsu
8,251,878 B2 8/2012 Liu et al.
8,808,151 B1 * 8/2014 Whaley ..... A63B 21/078 482/129
8,986,173 B1 3/2015 Adams
10,112,068 B2 10/2018 Medina
10,682,540 B2 6/2020 Manitone, III
10,960,254 B2 3/2021 Hurlbut
2002/0198081 A1 * 12/2002 Chen ..... A63B 21/00185 482/23
2008/0096737 A1 * 4/2008 Ayoub ..... A63B 21/0724 482/121
2008/0287273 A1 11/2008 Ma
2011/0098159 A1 4/2011 Wiseman
2011/0312477 A1 * 12/2011 Wiseman ..... A63B 21/0442 482/126
2012/0172182 A1 * 7/2012 Leier ..... A63B 21/0726 482/108
2014/0148852 A1 * 5/2014 Welch ..... A63B 21/045 482/121
2014/0162856 A1 * 6/2014 Kramer ..... A63B 21/0726 482/139
2016/0096061 A1 * 4/2016 Sanders ..... A63B 21/00065 482/122
2016/0144221 A1 * 5/2016 Wallander ..... A63B 21/0724 482/106
2017/0050065 A1 * 2/2017 Carter ..... A63B 21/16
2017/0209730 A1 * 7/2017 Sise ..... A63B 23/03525
(Continued)

FOREIGN PATENT DOCUMENTS

KR 200418023 Y1 * 6/2006

*Primary Examiner* — Sundhara M Ganesan
(74) *Attorney, Agent, or Firm* — Cramer Patent & Design PLLC; Aaron R. Cramer

(57) ABSTRACT

A pivoting dumbbell is an exercise device which allows use of exercise resistance bands with dumbbells. The exterior ends of a dumbbell rod are provided with a latching swivel hook. The swivel hook allows for unlimited three-hundred-sixty degree (360°) along the axis of the dumbbell using bearings. Each hook allows a user to attach one of a plurality of resistance exercise bands. The user may easily switch out the bands for bands of different resistance or even attach multiple bands at once.

1 Claim, 5 Drawing Sheets

(56) References Cited

U.S. PATENT DOCUMENTS

| | | | | |
|---|---|---|---|---|
| 2017/0266486 | A1* | 9/2017 | Anderson | A63B 21/4034 |
| 2019/0329084 | A1* | 10/2019 | Stewart | A63B 21/0557 |
| 2020/0121973 | A1* | 4/2020 | Jones | A63B 21/0728 |
| 2020/0155887 | A1* | 5/2020 | Hanners | A63B 21/4035 |
| 2021/0016133 | A1* | 1/2021 | Wu | A63B 22/20 |
| 2021/0023413 | A1* | 1/2021 | Nurge | A63B 21/4034 |
| 2021/0331019 | A1* | 10/2021 | Werner | A63B 21/00069 |
| 2022/0134169 | A1* | 5/2022 | Bou-Rabee | A63B 23/1209 482/93 |
| 2022/0134174 | A1* | 5/2022 | Schatz | A63B 21/4039 482/105 |
| 2022/0152444 | A1* | 5/2022 | Malcolm | A63B 21/4015 |
| 2022/0176185 | A1* | 6/2022 | Booker | A63B 21/4035 |
| 2022/0257992 | A1* | 8/2022 | Reed, III | A63B 21/0724 |

* cited by examiner

PIVOTING DUMBBELL

RELATED APPLICATIONS

Not applicable.

FIELD OF THE INVENTION

The presently disclosed subject matter is directed to a dumbbell and more specifically to a pivoting dumbbell.

BACKGROUND OF THE INVENTION

Physical fitness and health considerations are areas of highest concern among Americans today. More than ever, people are frequenting health clubs and performing exercise equipment routines at home in order to lose weight, improve muscle tone and maintain a healthy lifestyle. Many turn to the use of dumbbells for their exercise routines. Some have even resorted to applying exercise bands to the ends of the dumbbell to increase resistance and enhance their workout without the need for additional static weights. One disadvantage of such action is the tendency for the bands to bind around the dumbbell as it is rotated causing jerkiness and uneven motion. Others may find that the band may actually slip off during use resulting in a condition that may cause injury. Accordingly, there exists a need for a means by which exercise resistance bands can be used with dumbbells without the disadvantages as described above. The development of the pivotal dumbbell fulfills this need.

SUMMARY OF THE INVENTION

The principles of the present invention provide for a pivoting dumbbell device having a dumbbell body having a pair of ends, a pair of weighted ends disposed on the pair of ends of the dumbbell body, and a shaft connecting each pair of weighted ends together.

The dumbbell body may have a one-piece assembly. The dumbbell body may be made of cast metal. The dumbbell body may be coated with a rubberized coating. The pair of weighted ends may be removable. The pair of weighted ends may be selected from the group consisting of a pair of five-pound weighted ends, a pair of ten-pound weighted ends, a pair of fifteen-pound weighted ends, a pair of twenty-pound weighted ends, or a pair of twenty-five-pound weighted ends.

A pair of pivoting latch hooks may be disposed on an outward face of the respective weighted ends in a centered position. The pair of pivoting latch hooks may allow for the attachment of one or more resistance exercise bands. The pivoting latch hooks may be centrally positioned on an outward face of the respective weighted end. The rotation path may eliminate binding, uneven motion, and awkwardness associated with holding the one or more resistance exercise bands when holding the resistance exercise band and a conventional dumbbell body in hands of a user.

The pivoting latch hooks may be positioned within a bearing body. The bearing body may allow the pivoting latch hook to rotate within the weighted ends along a three hundred sixty-degree rotation path. An inner shaft may be in direct physical contact with the respective pivoting latch hook. The bearing body may include an outer race, an inner race, and a plurality of bearings. The bearings may be ball bearings. The bearings may be roller bearings. The one or more resistance exercise bands may provide additional resistance to movement of the dumbbell body versus gravity or momentum alone.

The one or more resistance exercise bands may provide for a better and more complete physical workout than without the one or more resistance exercise bands. The one or more resistance exercise bands may be selected from the group consisting of one or more therapy bands, one or more compact bands, one or more fit loop bands, one or more figure-eight bands, one or more ring bands, one or more lateral bands, or one or more pull up bands. A band midpoint may be secured to a secure location that is structurally sound and able to bear force exerted by the resistance exercise band.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
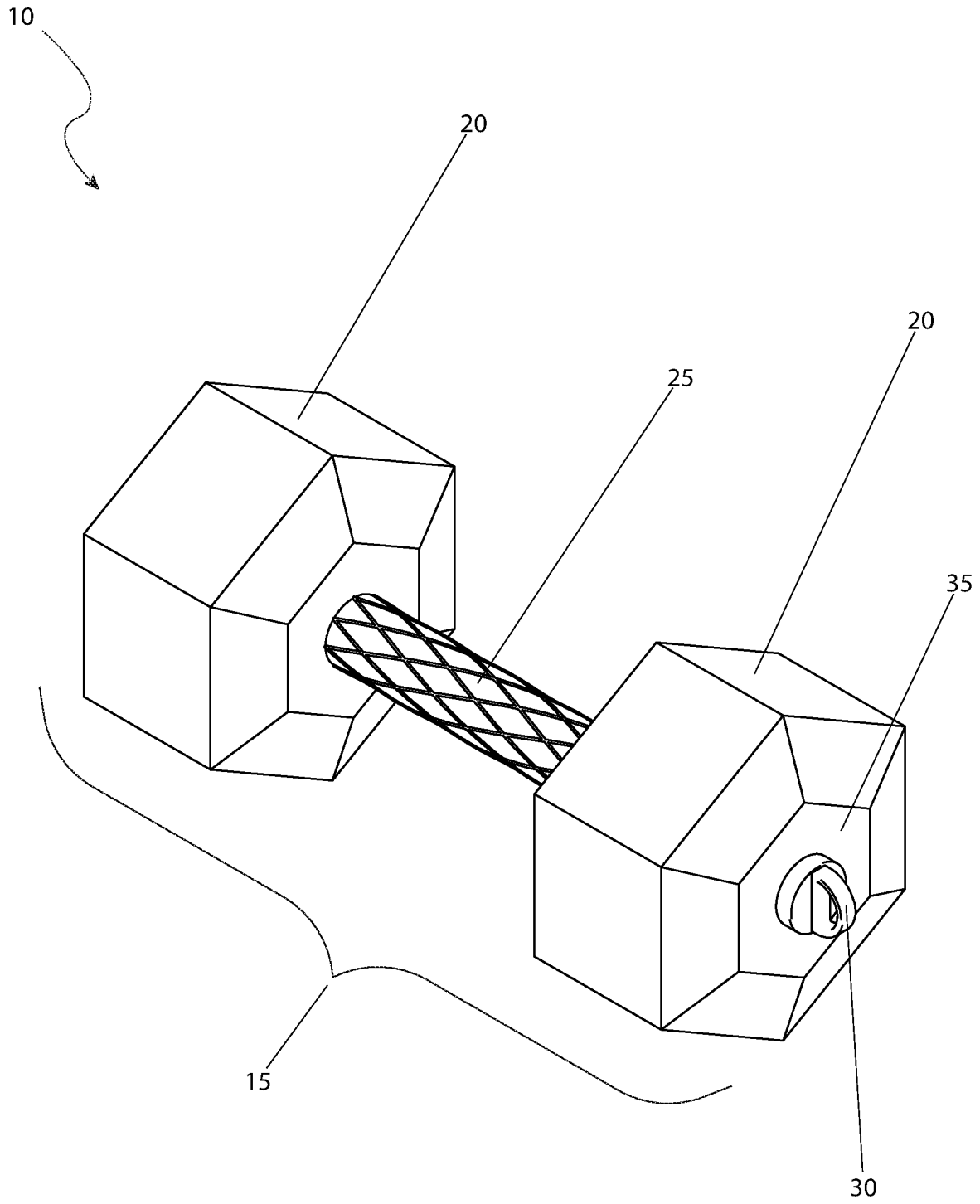
FIG. 1 is a perspective view of the pivoting dumbbell device, according to the preferred embodiment of the present invention.

10 pivoting dumbbell device
15 dumbbell body
20 weighted end
25 shaft
30 pivoting latch hook
35 outward face
40 resistance exercise band
45 bearing body
50 rotation path "r"
55 outer race
60 inner race
65 bearings
70 inner shaft
75 user
80 hand
85 band midpoint
90 secure location
95 foot
100 resisting force "a"
105 movement force "b"

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the pivoting dumbbell device 10, according to the preferred embodiment of the present invention is disclosed. The pivoting dumbbell device 10 (herein also described as the "device") 10, effectively enables the use of at least one (1) exercise resistance band 40 with dumbbell body 15 by a user 75. The device 10 utilizes an otherwise standard dumbbell body 15 having opposing weighted ends 20 connected by an interconnecting shaft 25. The dumbbell body 15 is depicted as a one-piece assembly, typically cast of metal and perhaps coated with a rubberized coating. However, other types of dumbbell bodies 15 having removable weighted ends 20 with a common shaft 25 may be used with the teachings of the device 10. Additionally, the current figure, as well as following figures depict only one (1) dumbbell body 15 for purposes of illustration. However, it is envisioned that the device 10 would be provided in paired sets with multiple sizes such as a pair of five-pound (5 lb.), ten-pound (10 lb.), fifteen-pound (15 lb.), twenty-pound (20 lb.), and twenty-five-pound (25 lb.) dumbbell bodies 15. As such, the use of the teachings afforded by the device 10 shall not be limited to any specific size of weighted ends 20, any specific quantity of device 10, or any specific configuration of the device 10, shall not be a limiting factor of the present invention. Two (2) pivoting latch hooks 30 (only one (1) is shown in FIG. 1 due to illustrative limitations) is provided on the outward face 35 of their respective weighted end 20 in a centered position. Further detail of usage, functionality, and configuration of the pivoting latch hooks 30 will be provided herein below.

Figure 2:
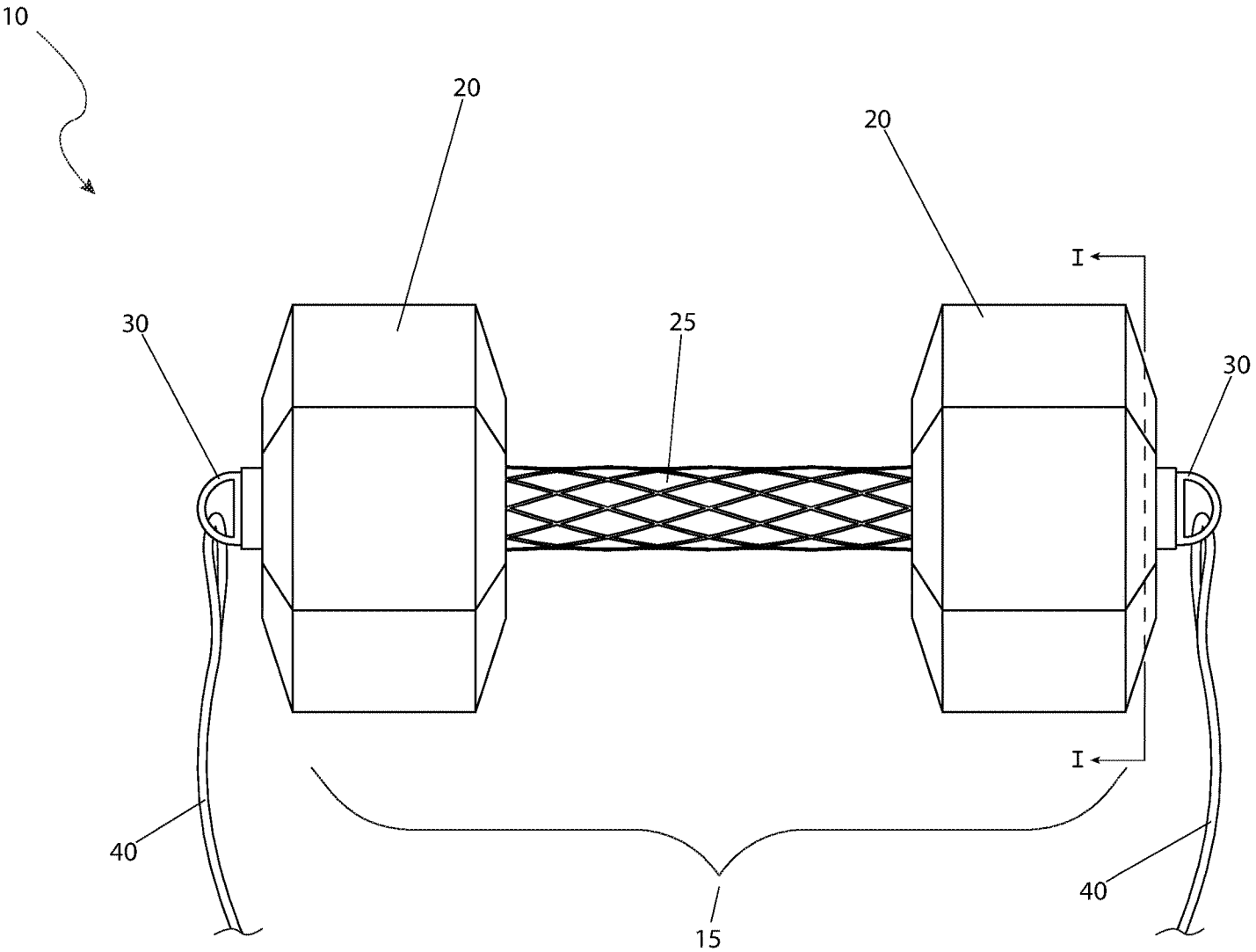
FIG. 2 is a side view of the pivoting dumbbell device, according to the preferred embodiment of the present invention.

Referring next to FIG. 2, a side view of the device 10, according to the preferred embodiment of the present invention is depicted. This side view further discloses the configuration of the dumbbell body 15, the weighted ends 20, and the shaft 25. The pivoting latch hooks 30 allow for the attachment of a resistance exercise band 40. At least one (1) resistance exercise band 40 provides additional resistance to movement of the dumbbell body 15 versus gravity or momentum alone. As such, the use of at least one (1) resistance exercise band 40 provides for a better, more complete physical workout. Further information on the usage of the resistance exercise band 40 with the device 10 will be provided below. The resistance exercise band 40 may be any type of elastic resistance device including, but not limited to: therapy bands, compact bands, fit loop bands, figure-eight bands, ring bands, lateral bands, and pull up bands. As such, the use of the device 10 with any specific type of resistance exercise band 40 shall not be interpreted as a limiting factor of the present invention.

Figure 3:
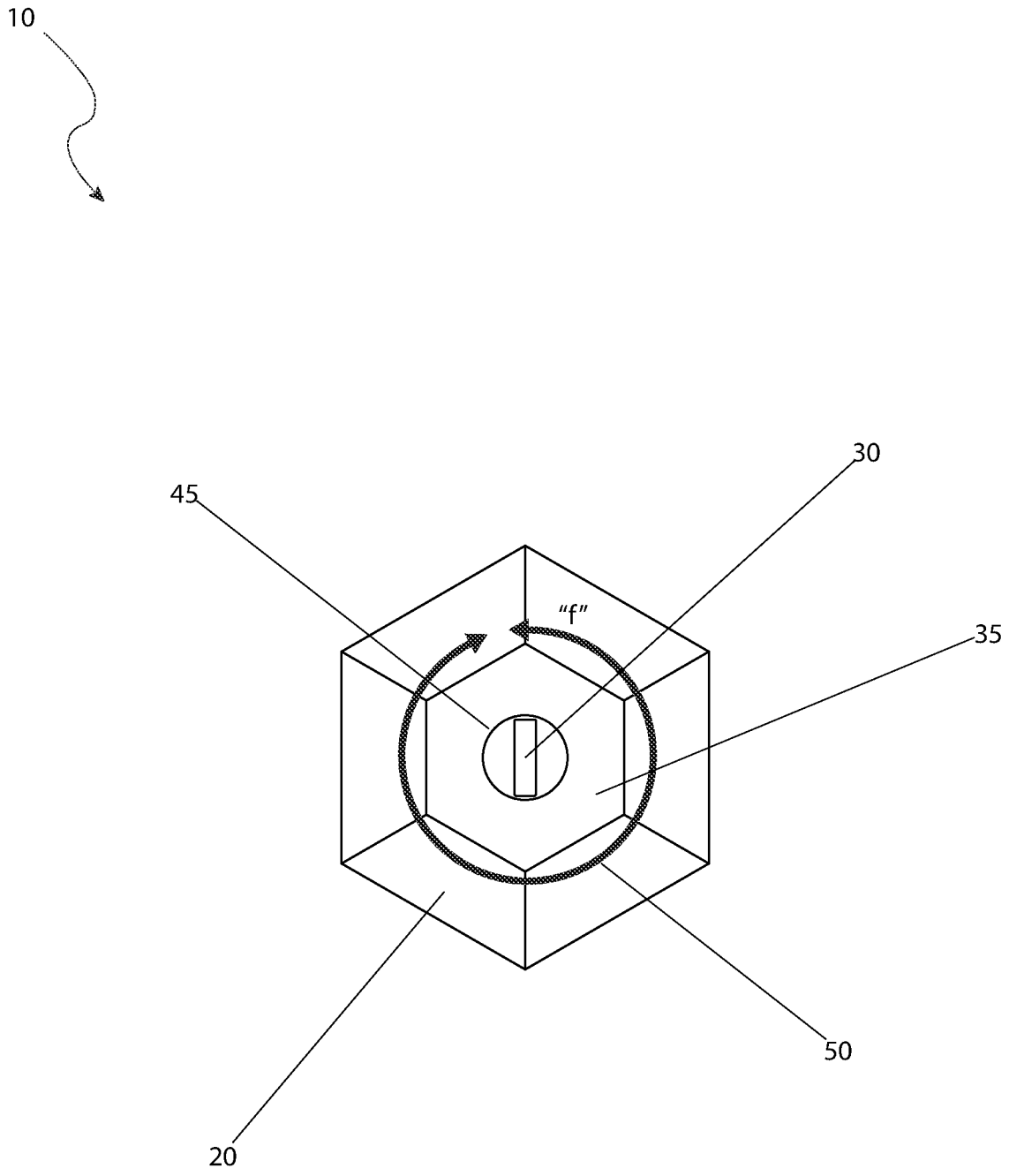
FIG. 3 is an end view of the pivoting dumbbell device, according to the preferred embodiment of the present invention.

Referring now to FIG. 3, an end view of the device 10, according to the preferred embodiment of the present invention is shown. This view provides greater detail on the configuration of the pivoting latch hook 30. As aforementioned described, the pivoting latch hooks 30 are centrally positioned on the outward face 35 of their respective weighted end 20. It is noted that the opposing pivoting latch hooks 30, located on the opposite weighted ends 20, is of an identical image of the pivoting latch hook 30 shown. Each pivoting latch hook 30 is positioned within a bearing body 45. Further information on the internal configuration of bearing body 45 will be provided herein below. The bearing body 45 allows the pivoting latch hook 30 to rotate within the weighted ends 20 along a three hundred sixty-degree) (360°) rotation path "r" 50. The rotation path "r" 50 eliminates the tendency of binding, uneven motion, and awkwardness usually associated with holding of a resistance exercise band 40 (as shown in FIG. 2) as typically experienced when holding the resistance exercise band 40 and a conventional dumbbell body 15 in hands of a user 75.

Figure 4:
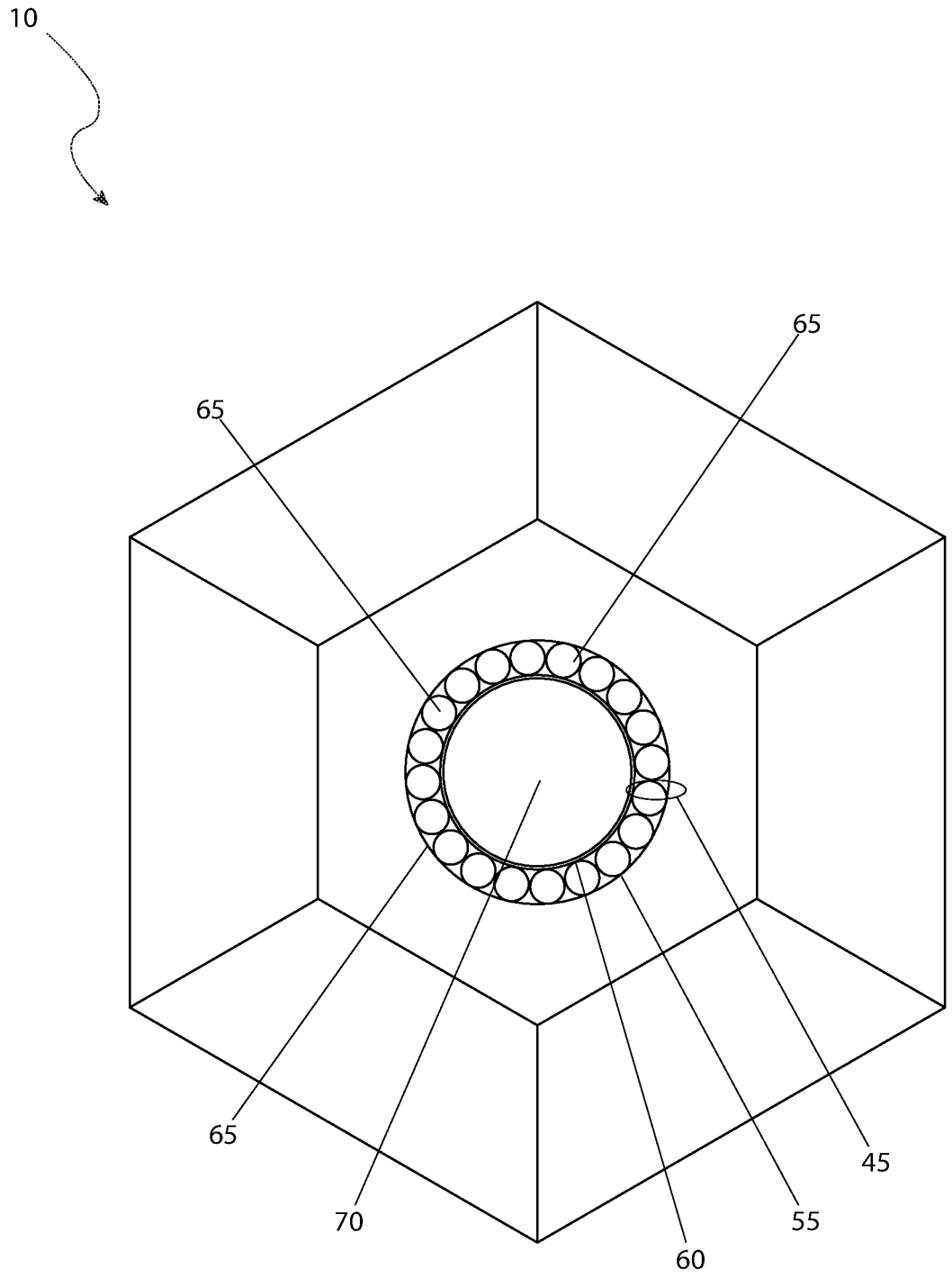
FIG. 4 is a sectional view of the pivoting dumbbell device, as seen along a Line I-I, as shown in FIG. 2, according to the preferred embodiment of the present invention.

Referring next to FIG. 4, a sectional view of the device 10, as seen along a Line I-I, as shown in FIG. 2, according to the preferred embodiment of the present invention is disclosed. This figure discloses the bearing body 45 having an outer race 55, an inner race 60, as well as a plurality of bearings 65. The bearings 65 may be either ball bearings or roller bearings, both of which can be depicted by the illustration of FIG. 4. An inner shaft 70 is in direct physical contact with the respective pivoting latch hook 30 (as shown in FIGS. 1 through 3). The use of the bearing body 45 provides a near frictionless operation of the pivoting latch hook 30 and thus produces a refined workout experience when using the device 10 with at least one (1) resistance exercise band 40 (as shown in FIG. 2).

Figure 5:
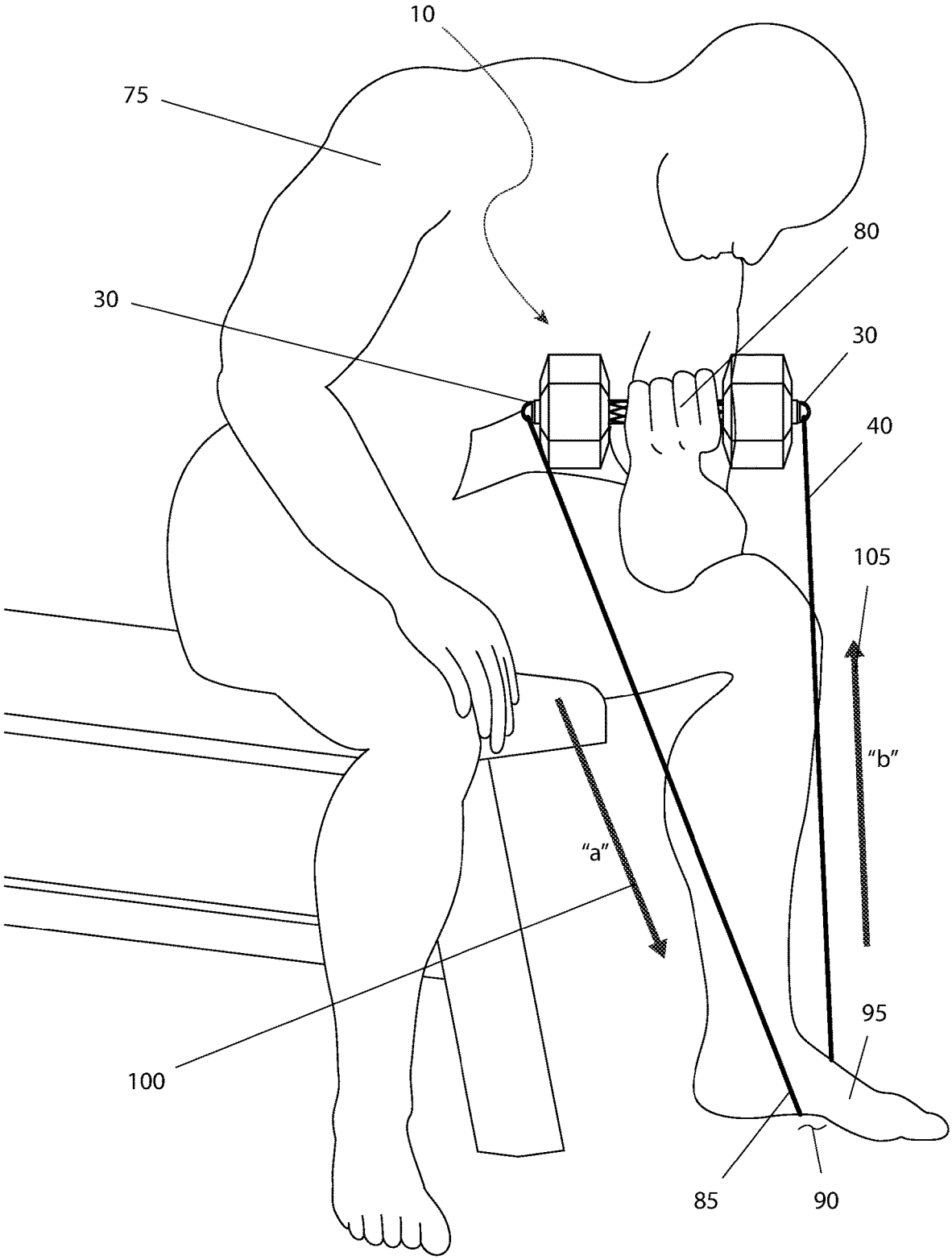
FIG. 5 is a pictorial view of the pivoting dumbbell device, shown in a utilized state, according to the preferred embodiment of the present invention.

Referring to FIG. 5, a pictorial view of the device 10, shown in a utilized state, according to the preferred embodiment of the present invention is depicted. A user 75 holds the device 10 in a single hand 80. At least one (1) resistance exercise band 40 is connected to both of the pivoting latch hooks 30. A band midpoint 85 is then secured to a secure location 90 that is structurally sound and able to bear the force exerted by the resistance exercise band 40. In the case of FIG. 5, the secure location 90 is depicted as the foot 95 of the user 75. Other points that may serve as a secure location 90 include, but are not limited to: exercise equipment, furniture of significant weight, attachment points or the like. The use of the device 10 with any one (1) particular type of secure location 90 is not intended to be a limiting factor of the present invention. As such, the secure location 90 produces a resisting force "a" 100 which counteracts a movement force "b" 105 of the device 10, throughout the entire range of motion of the device 10. The exercise routines by the user 75 using the device 10 may vary widely and are beyond the scope of the present invention. It is appropriate that any current or future exercise routines that utilize a conventional dumbbell body 15 can be reproduced with the teachings of the device 10 in a way that enhances the said exercise routine.

2. Operation of the Preferred Embodiment

The preferred embodiment of the present invention can be utilized by the common user 75 in a simple and effortless manner with little or no training. It is envisioned that the device 10 would be constructed in general accordance with FIG. 1 through FIG. 5. The user 75 would procure the device 10 from conventional procurement channels such as sporting goods stores, discount stores.

After procurement and prior to utilization, the device 10 would be prepared in the following manner: at least one (1) resistance exercise band 40 of the desired strength and resistant would be connected to the pivoting latch hooks 30 of the device 10; the midpoint of the resistance exercise band 40 would be connected to a secure location 90 of secure strength such that it can produce the necessary resisting force "a" 100. At this point in time, the device 10 is ready for use.

During utilization of the device 10, the user 75 would complete various repetitions moving the device 10 through its range of motion while experiencing the additional resisting force "a" 100 afforded by the at least one (1) resistance exercise band 40. It is envisioned that a complete workout session may include different motion ranges, different dumbbell bodies 15 (of various weight), and/or different styles, types, or number of resistance exercise bands 40 (different length and/or resistance). As such, the usage of the device 10 is myriad.

It is envisioned that the features of the device 10 provide the following benefits over usage of a conventional dumbbell body 15 (or dumbbell sets) and resistance exercise bands 40: a complete resistance throughout the entire range of motion performed during exercises, no binding of the resistance exercise band 40 against the surface of the dumbbell body 15; a lack of slipping off of the dumbbell body 15; a way to customize the device 10 as resistance can be varied by swapping out of the resistance exercise band 40; an enhanced transportability for travel as static weight is not required; and an ability to function as a conventional dumbbell body 15 by not using the resistance exercise band 40.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A pivoting dumbbell device comprising:

a dumbbell body having a central shaft with opposing weighted ends, each of the opposing weighted ends including an outward face;

a pair of pivoting latch hooks, each of the pivoting latch hooks being centrally positioned on the outward face of a respective one of the opposing weighted ends, wherein each of the pivoting latch hooks is configured to rotate freely about a 360-degree rotation path;

a bearing body positioned within each of the opposing weighted ends and configured to support the rotation of the respective pivoting latch hook, wherein each bearing body comprises:

an outer race fixed within the respective weighted end;

an inner race connected to the respective pivoting latch hook; and, a plurality of bearings disposed between the outer race and the inner race, thereby facilitating near-frictionless rotation of the respective pivoting latch hook relative to the respective weighted end; and, at least one resistance exercise band configured to be detachably secured to the pivoting latch hooks, wherein the at least one resistance exercise band is capable of generating a resisting force counteracting a movement force applied by a user during exercise; and, wherein the pivoting latch hooks, in conjunction with the bearing bodies, enable the at least one resistance exercise band to move smoothly without binding or creating uneven motion, thereby providing continuous and consistent resistance throughout the entire range of motion of the dumbbell body, enhancing the effectiveness and comfort of the workout for the user.

* * * * *